US006971885B2

(12) United States Patent
Mowry

(10) Patent No.: US 6,971,885 B2
(45) Date of Patent: Dec. 6, 2005

(54) INTERCONNECT DEVICE WITH OPPOSINGLY ORIENTED CONTACTS

(75) Inventor: Thomas E. Mowry, Cardiff, CA (US)

(73) Assignee: Teledyne Technologies Incorporated, Los Angeles, CA (US)

( * ) Notice: Subject to any disclaimer, the term of this patent is extended or adjusted under 35 U.S.C. 154(b) by 0 days.

(21) Appl. No.: 10/780,936

(22) Filed: Feb. 18, 2004

(65) Prior Publication Data

US 2005/0181638 A1 Aug. 18, 2005

(51) Int. Cl.[7] ..... H01R 12/00
(52) U.S. Cl. ..... 439/66
(58) Field of Search ..... 439/66, 67, 70–71, 439/525–526, 862, 74, 83; 29/884, 874, 877, 29/825, 829; 361/760, 772

(56) References Cited

U.S. PATENT DOCUMENTS 5,395,252 A * 3/1995 White ..... 439/66
5,967,797 A 10/1999 Maldonado
5,975,914 A * 11/1999 Uchida ..... 439/66
6,045,367 A 4/2000 Maldonado
6,532,654 B2 * 3/2003 Guerin et al. ..... 29/884
6,604,950 B2 8/2003 Maldonado et al.
6,843,659 B2 * 1/2005 Liao et al. ..... 439/66
2002/0160632 A1 10/2002 Maldonado et al.
2003/0114025 A1 6/2003 Maldonado et al.

* cited by examiner

*Primary Examiner*—J. F. Duverne
(74) *Attorney, Agent, or Firm*—Kirkpatrick & Lockhart Nicholson Graham LLP

(57) ABSTRACT

An interconnect device for electrically interconnecting two components is disclosed. According to various embodiments, the interconnect device includes a frame having a upper side and a lower side, a first plurality of beam contacts on the upper side for connection to contacts of the first component, and a second plurality of contacts on the lower side of the frame for connection to contacts of the second component. The beam contacts on the upper side of the frame are arranged so that the sum of the sideways wipe forces caused by compression of the beam contacts on the upper side due to connection of the first component to the interconnect device approximately equals zero.

24 Claims, 6 Drawing Sheets

INTERCONNECT DEVICE WITH OPPOSINGLY ORIENTED CONTACTS

BACKGROUND OF INVENTION

The present invention pertains to interconnect devices for electrically interconnecting the contacts of a first component to contacts of a second component.

An electrical interconnector having a plurality of electrical conductors can be used to interconnect one electronic component, such as a microprocessor or ASIC, to another electronic component, such as a printed circuit board. Typically, interconnect devices include a frame having two opposed contact surfaces for respective engagement with a corresponding contact surface of one of the electronic components. Electrical conductors (or contacts) on each side of the frame are electrically connected to the contacts of the respective components such that the two components are thereby electrically connected. The frame of the interconnect device functions to secure the positions of the electrical conductors relative to one another and to electrically isolate the electrical conductors from one another.

Today's microprocessors and ASICs often have thousands of densely spaced contacts. Correspondingly, interconnect devices for such components must have thousands of densely spaced contacts. One such known interconnect device is shown in FIGS. 1–2. The interconnect device 10 includes a frame 12 having a number of electrical conductors 14. Each conductor 14 has a beam contact portion 16, 18 on opposite sides of the frame 12 such that there is an electrical connection between the two contact portions 16, 18. The interconnect device 10 electrically connects the first component 20 to the second component 22. As such, the first component 20 includes a plurality of spaced apart contacts 24 for connection to the contact portions 16 and the second component 22 includes a plurality of spaced apart contacts 26 for connection to the contact portions 18. Accordingly, each electrical conductor 16 establishes an individual electrical connection between a contact 24 of the first component 20 and a contact 26 of the second component 22.

For a interconnect device 10 such as illustrated in FIGS. 1–2, when the beam contacts 16, 18 are compressed due to placement of the first and second components 20, 22 on the device 10, the beam contacts move in an arc and thereby generate a wiping action against a mating surface 28 of the frame 12, resulting in a sideways force (the "wipe force") 29, as shown in FIG. 3. Although the individual wipe force from one beam contact may be relatively small, for electrical devices having thousands of densely spaced contacts the cumulative wipe force of all the beam contacts of the interconnect device can be quite high. For example, testing of such devices has shown that for a interconnect device having 2400 contacts, the cumulative sideways wipe force can be twenty pounds. This can be problematic. As the conductors are compressed, the contacts must be kept in proper alignment to the mating surfaces of the components to be connected together. Such a large wipe force limits how the parts can be kept in alignment because many alignment techniques cannot withstand such large sideways wipe forces.

One known technique of mitigating this problem is to use a contact that does not generate a wipe action. Such contacts, however, lose the cleaning action that the wipe action provides. Other drawbacks of such contacts include deflection range and cost. Another known technique is to use alignment techniques that can withstand such large wipe forces, such as using large, sturdy alignment surfaces and/or alignment pins. While such techniques may be acceptable for some applications, such large sidewalls and/or alignment pins can present space and tolerance problems in other applications.

Accordingly there exists a need for an interconnect device that minimizes or eliminates the cumulative wipe forces, yet provides the beneficial wipe action, is relatively inexpensive to manufacture, and which has the capability of satisfying tight and/or small dimensional requirements.

SUMMARY OF THE INVENTION

In one general respect, embodiments of the present invention are directed to an interconnect device for electrically interconnecting a first component to a second component. According to various embodiments, the interconnect device includes a frame having a upper side and a lower side, a first plurality of beam contacts on the upper side for connection to contacts of the first component, and a second plurality of contacts on the lower side of the frame for connection to contacts of the second component. Each beam contact on the upper side of the frame is electrically connected to a contact on the lower side of the frame. In addition, the beam contacts on the upper side of the frame are arranged such that the sum of the sideways wipe forces caused by compression of the beam contacts on the upper side of the frame due to connection of the first component to the interconnect device approximately equals zero or is below some threshold amount, such as 5 pounds. For example, a first portion of the first plurality of beam contacts may be oriented to face a first direction and a second portion of the second plurality of beam contacts may be oriented to face a second direction opposite to the first.

According to various other embodiments, the second plurality of contacts, on the lower side of the frame, may include beam contacts. The beam contacts on the lower side of the frame may also be arranged so that the sum of the sideways wipe forces caused by compression of the beam contacts on the lower side due to connection of the second component to the interconnect device approximately equals zero or is below the threshold amount. In addition, the first component may be, for example, an integrated circuit and the second component may be a printed circuit board (PCB).

According to another embodiment, the first plurality of beam contacts, on the upper side of the frame, may be arranged in columns such that the beam contacts in a first portion of the columns are oriented in a first direction and the beam contacts in a second portion of the columns are oriented in an opposite direction relative to the first direction, such that the sum of the sideways wipe forces caused by compression of the beam contacts in the first and second portions of the columns due to connection of the first component to the interconnect device approximately equals zero or is below the threshold amount. The plurality of beam contacts on the lower side of the frame may be similarly arranged.

In another general respect, embodiments of the present invention are directed to a method of fabricating an interconnect device for electrically interconnecting a first component to a second component. The method includes molding a frame of the interconnect device such that a plurality of electrical conductors are molded into the frame, wherein each electrical conductor includes a first beam contact portion extending from an upper side of the frame and a second beam contact portion extending from a lower side of the frame. The method further includes shaping the electrical conductors such that the first beam contact portions extending from the upper side of the frame are arranged such that the sum of the sideways wipe forces caused by compression of the first beam contact portions due to connection of the first component to the interconnect device approximately equals zero or is below the threshold amount. In addition, the method may include shaping the electrical conductors such that the second beam contact portions extending from the lower side of the frame are arranged such that the sum of the sideways wipe forces caused by compression of the second beam contact portions due to connection of the second component to the interconnect device approximately equals zero or is below the threshold amount.

DESCRIPTION OF THE FIGURES

Embodiments of the present invention are described by way of example in conjunction with the following figures, wherein.

DETAILED DESCRIPTION OF THE INVENTION

Figure 1:
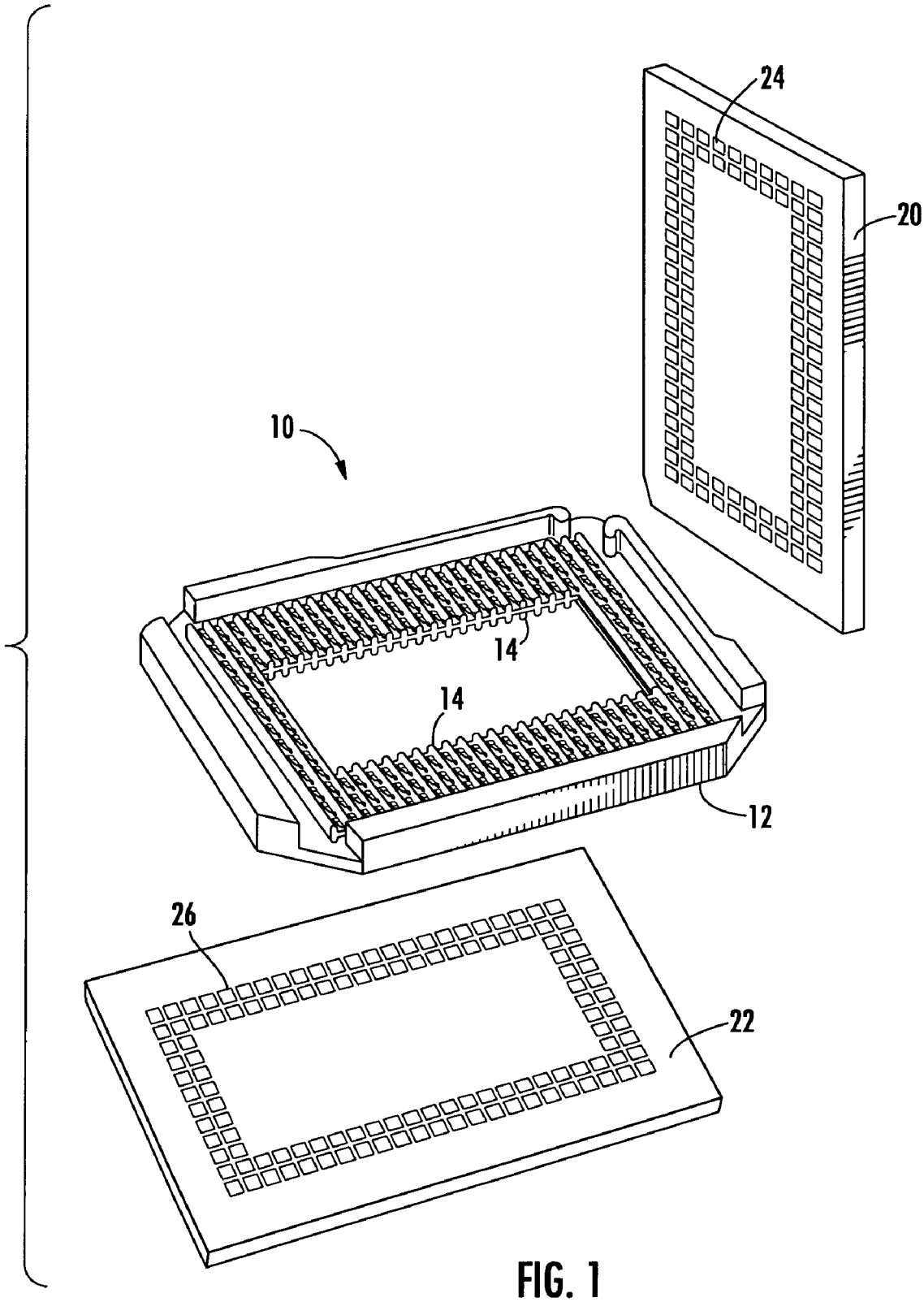
FIG. 1 (PRIOR ART)
FIGS. 1–2 depict a prior art interconnect device.
Figure 2:
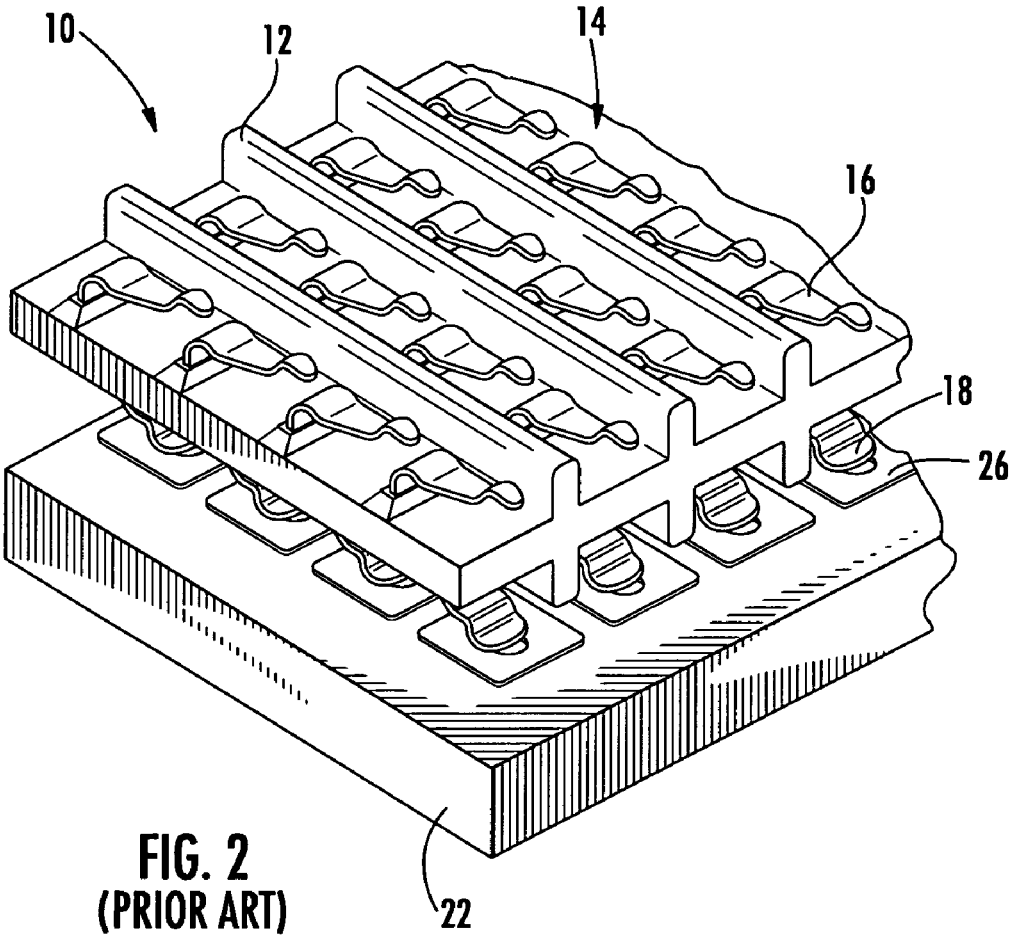
FIG. 2 (PRIOR ART)
Figure 3:
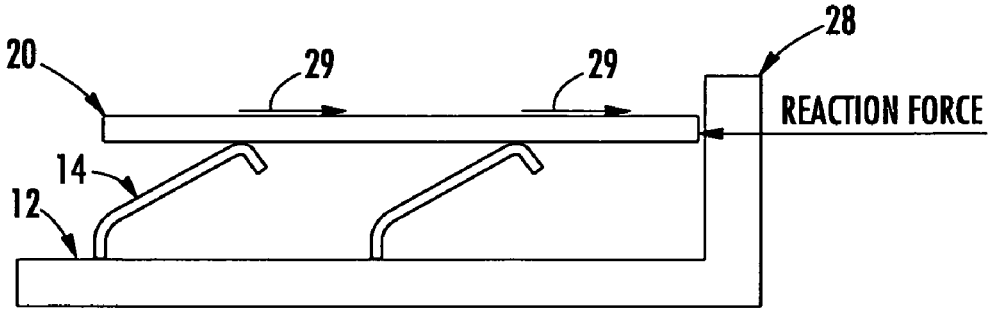
FIG. 3 (PRIOR ART)
FIG. 3 is a diagram illustrating sideways wipe forces in a prior art interconnect device.
Figure 4:
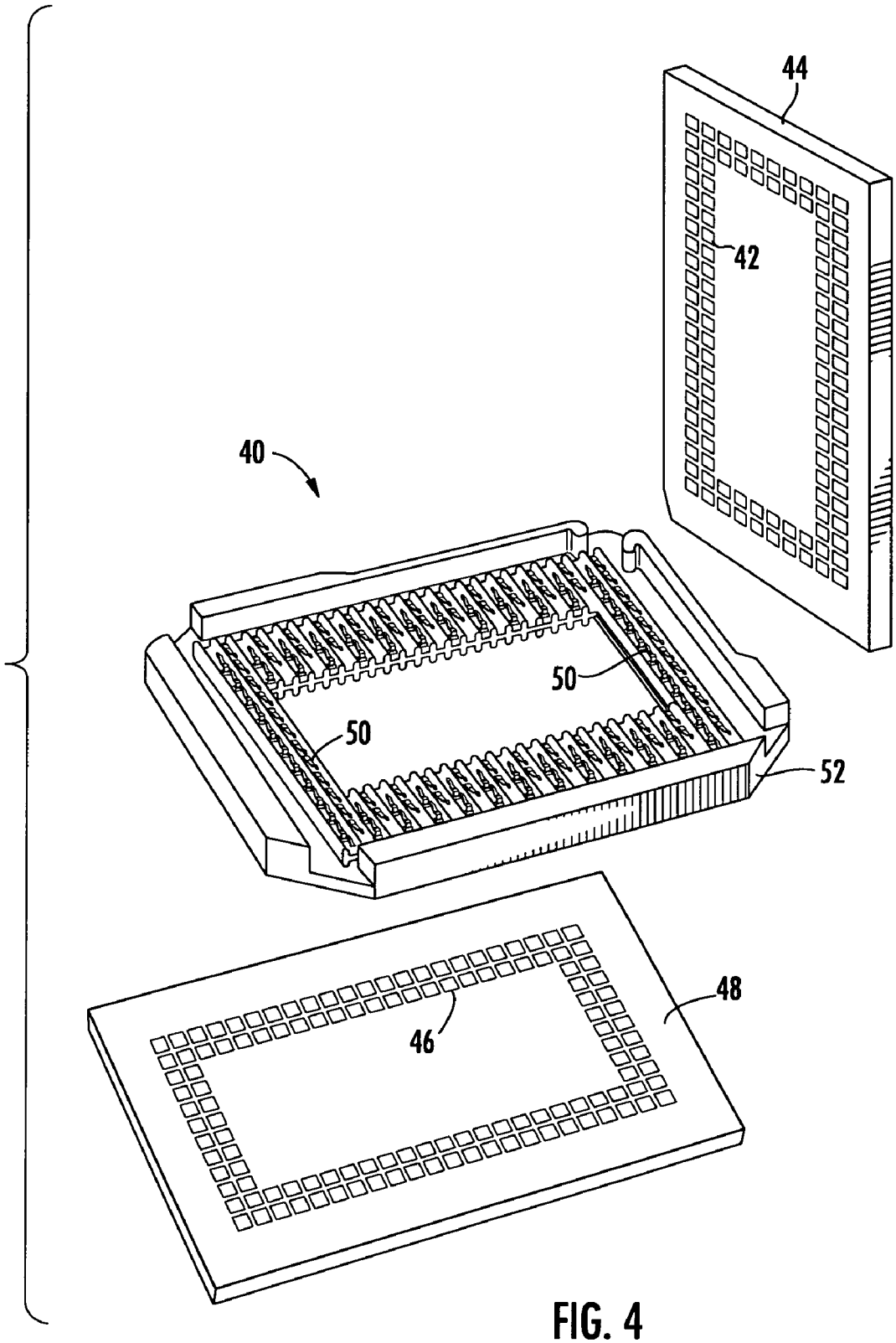
FIGS. 4–7 depict an interconnect device according to various embodiments of the present invention.
Figure 5:
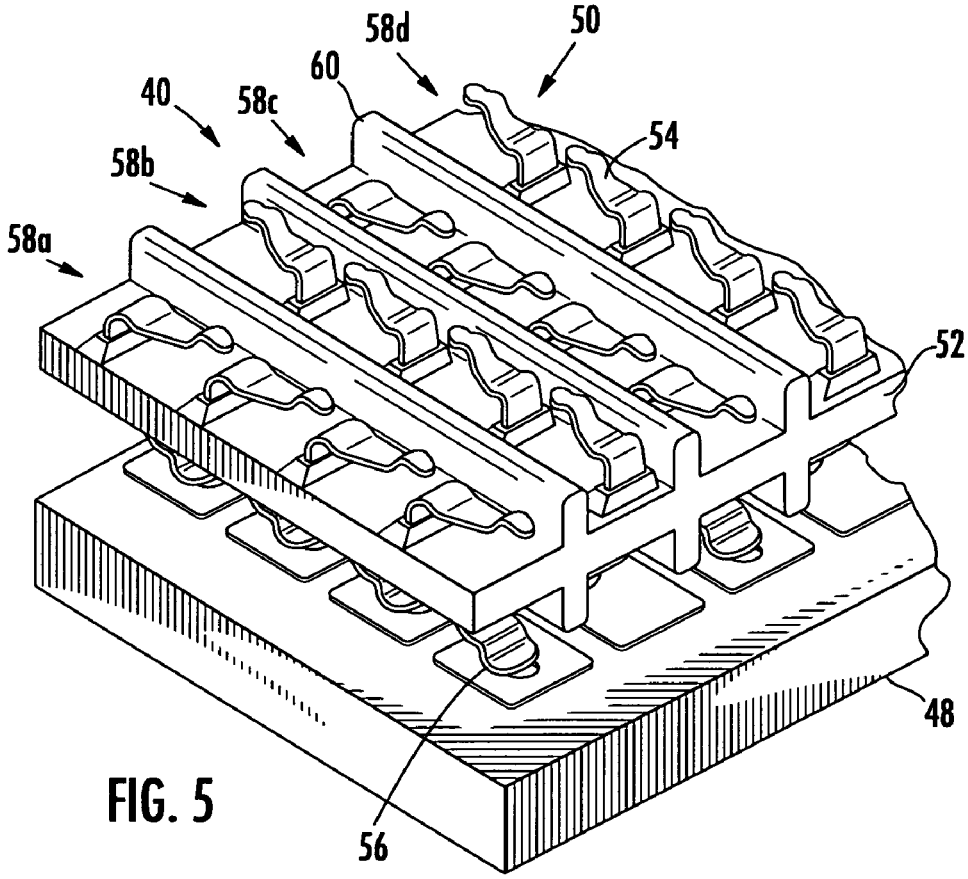
Figure 6:
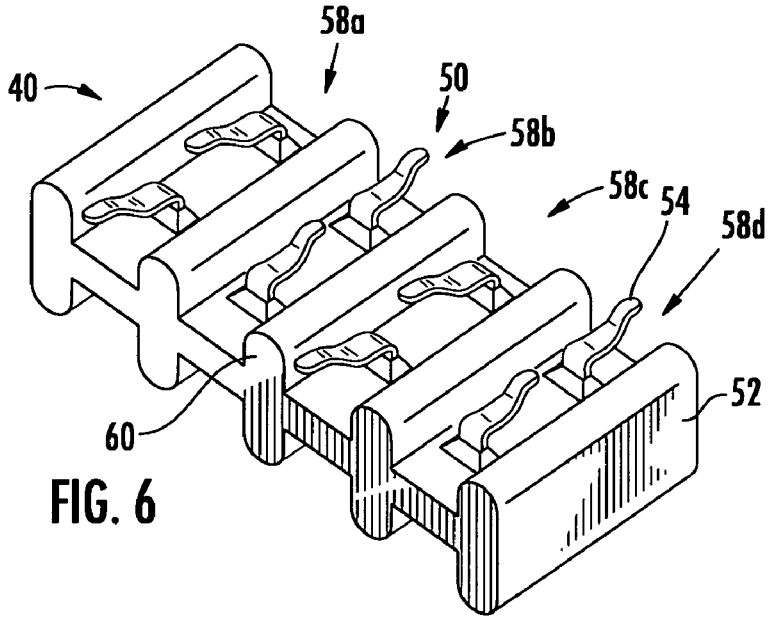
Figure 7:
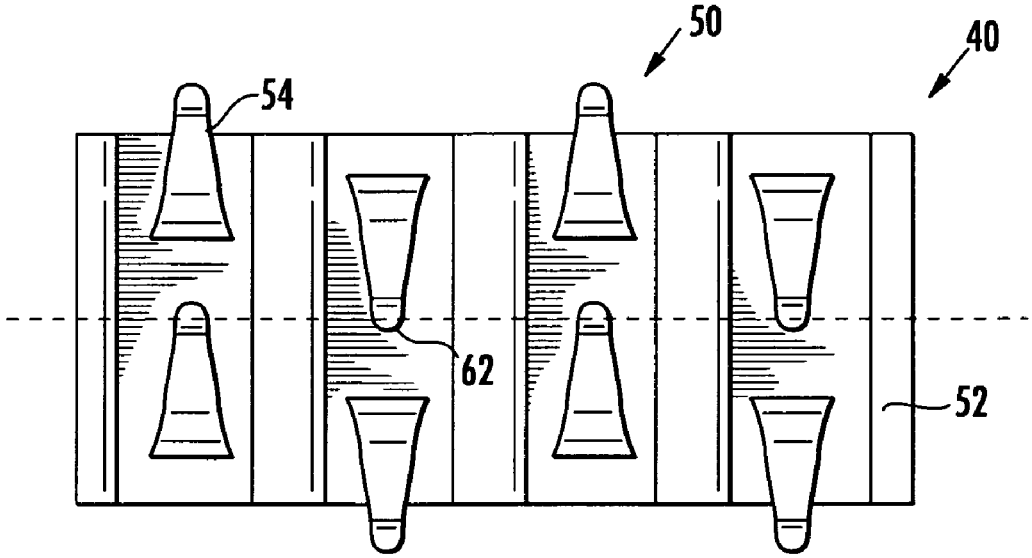

FIGS. 4–7 depict an interconnect device 40 according to various embodiments of the present invention. The interconnect device 40 may be used to electrically interconnect contacts 42 on a first component 44 to corresponding contacts 46 a second component 48. FIG. 4 is a perspective view of the interconnect device 40 together with the first and second components 44, 48. FIG. 5 is a perspective side view of a portion of the interconnect device 40 with a portion of the second (e.g., bottom) component 48. FIG. 6 is another perspective view of a portion of the interconnect device 40 and FIG. 7 is a top plan view of a portion of the interconnect device 40.

The contacts 42, 46 may be, for example, lands or pads of various shapes and sizes. For example, as illustrated in FIG. 4, each contact 42, 46 may be a land that is a rectangular shaped flat surface. The plurality of contacts 42, 46 of the first and second components 44, 48, arranged in rows/columns as shown in FIG. 4, may be considered to constitute a "land grid array." The first component 44 may be an integrated circuit such as, for example, a microprocessor or an ASIC. The second component 48 may be, for example, a printed circuit board (PCB). As such, the interconnect device 40 may be referred to as a "microprocessor connector," a "socket," an "interposer," or a "land grid array (LGA) socket."

According to various embodiments, as shown in FIGS. 4–7, the interconnect device 40 includes a number of electrical conductors 50 extending through a frame 52. Each conductor 50 may include a beam contact portion 54 on an upper side of the interconnect device 40 and a beam contact portion 56 on a lower side of the interconnect device 40. The upper beam contact portions 54 may contact respective and corresponding contacts 42 on the first component 44 and the lower beam contact portions 56 may similarly contact respective and corresponding contacts 46 on the second component 48. As such, the electrical conductors 50 may provide an electrical connection between the contacts 42 of the first component 44 and the corresponding contacts 46 of the second component 48.

The electrical conductors 50 may be fabricated from an electrically conductive material such as, for example, BeCu. The electrical conductors 50 may be stamped or formed from metallic strips that are approximately 0.001 to 0.003 inches in thickness. Further, portions of the electrical conductors 50 may be completely or selectively gold-plated on one side to a thickness of between three and fifty microinches to enhance the conductivity of the conductors 50. The conductors 50 may be spaced, for example, 1 mm apart.

The frame 52 may be made from an electrically nonconductive material, such as thermoplastic, to provide electrical insulation between the numerous conductors 50. The shape, size and design of the frame 52 can be varied to be compatible with particular variations of the first and second components 44, 48.

According to various embodiments, as shown in FIGS. 4–7, the frame 52 may define a number of channels 58 on both the upper and lower surfaces thereof. The channels 58 may be separated by raised sidewalls 60 on both the upper and lower surfaces of the frame 52. The beam contact portions 54, 56 may be positioned in the respective channels 58.

In the illustrated embodiments of FIGS. 4–7, the conductors 50 have compression-type beam contact portions 54, 56. As such, when the beam contact portions 54, 56 are compressed due to placement of the first and second components 44, 48 on the device 40, the beam contacts 54, 56 move in an arc, thereby generating sideways wipe forces. According to various embodiments of the present invention, in order to mitigate the problematic cumulative sideways wipe forces of the contacts in the prior art, a first portion of the conductors 50 of the interconnect device 40 may face one direction and a second portion of the conductors 50 may face an opposite direction. That is, for example, with reference to FIG. 5, the beam contact portions 54, 56 in channels 58*a*, 58*c* may face one direction (down and to the right in FIG. 5) and the beam contact portions 54, 56 in channels 58*b*, 58*d* may face in the opposite direction (up and to the left in FIG. 5). When the number of beam contact portions 54 facing the first direction equals the number of beam contact portions 54 oriented to face the second (opposite) direction, the cumulative wipe forces 61 generated by compression of the beam contacts 54 can be effectively canceled, as shown in the example of FIG. 8.

Figure 8:
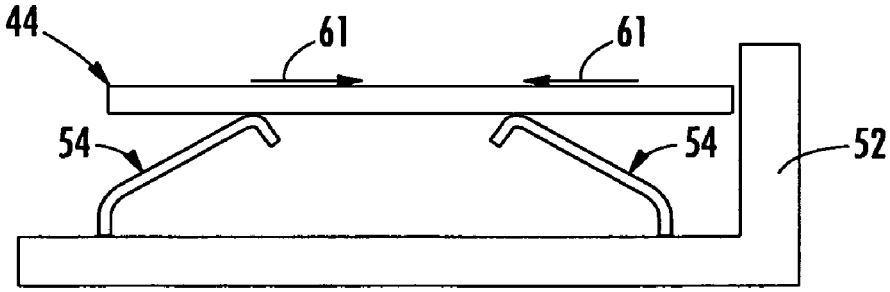
FIG. 8 is a diagram illustrating the cancellation of the sideways wipe forces with an interconnect device according to various embodiments of the present invention.

FIG. 8 shows an embodiment in which a portion of the frame 52 of the interconnect device 10 is used to align the component 44 on the interconnect device 10. According to other embodiments, rather than using an alignment feature of the frame 52 to align the component 44, a post, screw or solder ball, for example, may be used to align the component 44. Canceling sideways swipe forces can be especially advantageous for such alignment techniques because these small features are typically less able to withstand the cumulative sideways swipe forces involved in conventional designs.

According to various embodiments, the orientation of the conductors 50 may alternate by channel 58, as shown in the example of FIGS. 4–7. That is, the conductors 50 in every other channel 58 may be oriented in the first direction and the conductors in the intervening channels 58 may be oriented in the opposite direction. Thus, the configuration of the conductors 50 may be considered to be an array of columns and rows, with the columns being in the direction of the contact beams 54, 56 (i.e., along the channels 58) and the rows being cross ways to the contact beams 54, 56. Orienting the conductors 50 in a particular column (i.e., channel 58) in the same direction may simplify manufacture and keep conductors pointed in one direction from interfering with conductors in the other direction.

According to alternative embodiments, rather than an every-other-one arrangement, the conductors in two (or more) adjacent channels may face the first direction and the conductors in the adjacent two (or more) channels may face the opposite direction (an every-other-two arrangement), and so on. When the number of conductors 50 in the first direction roughly equals the number of conductors 50 in the opposite direction, the cumulative wipe forces generated by compression of the beam contacts can be effectively canceled. That is, the vector sum of the wipe forces may approximately equal zero. The number of conductors oriented in the first direction need not exactly equal the number in the opposite direction. According to various other configurations, the conductors may be oriented in more than two different directions (such as three or four different directions), such that the vector sum of the cumulative wipe forces approximately equals zero. According to other embodiments, the vector sum of the cumulative wipe forces may be less that some threshold, such as the amount of force that the alignment device can easily withstand, such five pounds or less.

According to various embodiments, a midsection of the electrical conductors 50 may be molded in place in the frame 52 such that the beam contact portions 54, 56 extend outwardly from the frame 52 on the upper and lower sides, respectively, thereof. The beam contact portions 54, 56 may be shaped before or after the midsections of the conductors 50 are molded into place within the frame 52. As shown in FIGS. 6 and 7, the opposite direction contact beams may be offset such that, when compressed, the contact tips 62 are in line or a set offset distance from each other.

According to other embodiments, the frame 52 may define a plurality of holes, and the mid-portions of the conductors 50 may be disposed in the holes. Also, according to various embodiments, the frame 52 may be flat and therefore not include channels or ribs 58, as shown in FIGS. 4–7.

Figure 9:
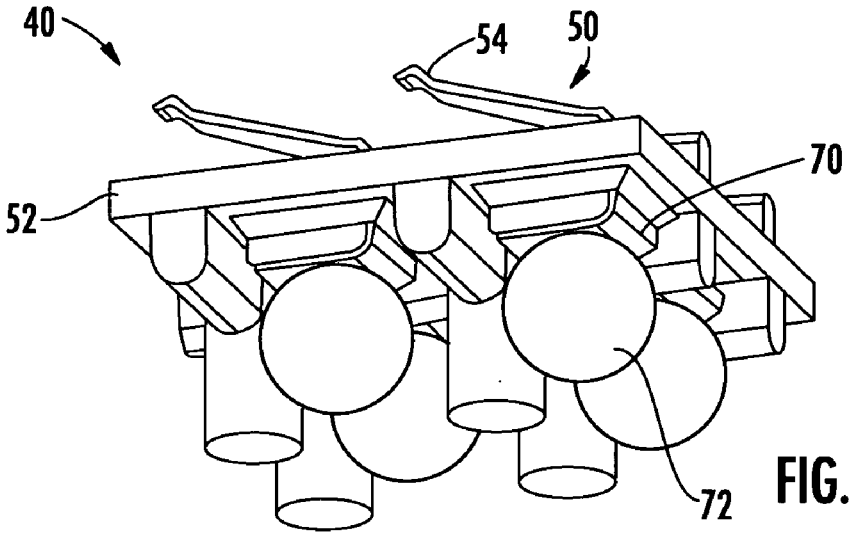
FIGS. 9–10 illustrate an embodiment of the interconnect device according to various embodiments of the invention with solder balls connected to one side thereof.
Figure 10:
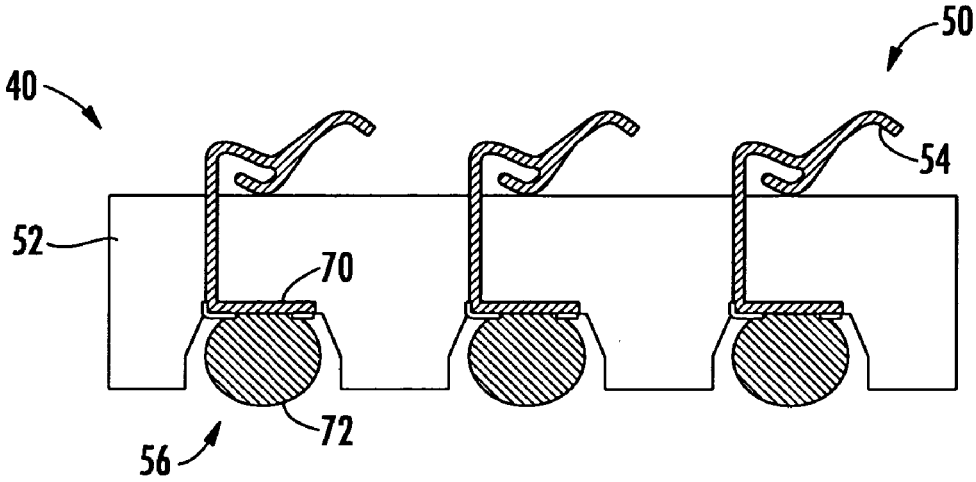

In the illustrated embodiments of FIGS. 4–7, the beam contacts 54, 56 on each side of the interconnect device 40 are oriented to cancel the sideways wipe forces. According to various other embodiments, only the beam contacts on one side of the interconnect device 40 (such as the beam contacts 54 on the upper side of the frame 52) may be oriented to cancel the sideways wipe forces. Also in the illustrated embodiments of the FIGS. 4–7, the beam contacts 54, 56 are shown as compression-type contacts. According to various other embodiments, the contacts on one side of the interconnect device 40 (such as the contacts 54 on the lower side) may be, for example, surface mount soldered (SMT) contacts or ball grid array (BGA) type contacts. For example, the contacts 54 on the upper side of the frame 52 may be pressure-type beam contacts (oriented to cancel sideways swipe forces), and the contacts 56 on the lower side of the frame 52 may comprise, for example, a land 70 with a solder ball 72 connected thereto, as shown in FIGS. 9 and 10. The solder balls 72 may be connected to the lands 70 prior to connection to the second component 48, as described in my co-pending U.S. patent application Ser. No. 10/678,250, entitled "Interconnect Apparatus, System, and Method," filed Jan. 30, 2004, which is incorporated herein by reference. Alternatively, the solder balls 72 may be connected to the contacts 46 of the second component 48 prior to connection to the lands 70 of the interconnect device 40.

Also in the illustrated embodiments of FIGS. 4–7, the channels 58 on the upper and lower sides of the frame 52 are lined up. That is, a channel 58 on the lower side is directly below a channel 58 on the upper side. According to yet other embodiments, the channels 58 on the upper and lower sides of the frame 52 may be offset such that a channel on the lower side is not directly below a channel on the upper side. For more details regarding such embodiments, refer to U.S. Pat. No. 5,967,797, U.S. Pat. No. 6,045,367, U.S. Pat. No. 6,604,950, published U.S. patent application Ser. No. 2002/0160632 and published U.S. patent application Ser. No. 2003/0114025, which are incorporated herein by reference.

While several embodiments of the invention have been described, it should be apparent, that various modifications, alterations and adaptations to those embodiments may occur to persons skilled in the art with the attainment of some or all of the advantages of the present invention. For example, different materials may be used and steps of the disclosed processes may be performed in different orders. It is therefore intended to cover all such modifications, alterations and adaptations without departing from the scope and spirit of the present invention as defined by the appended claims.

What is claimed is:

1. An interconnect device, comprising:

a frame having an upper side and a lower side;

a first plurality of beam contacts on the upper side of the frame for connection to contacts of a first component, wherein the first plurality of beam contacts are arranged such that the sum of the sideways wipe forces caused by compression of the first plurality of beam contacts due to connection of the first component to the interconnect device approximately equals zero; and a second plurality of contacts on the lower side of the frame for connection to contacts of a second component, wherein each beam contact of the first plurality of contacts is electrically connected to a contact of the second plurality of contacts.

2. The interconnect device of claim 1, wherein the second plurality of contacts on the lower side of the frame includes beam contacts, and wherein the second plurality of beam contacts are arranged such that the sum of the sideways wipe forces caused by compression of the second plurality of beam contacts due to connection of the second component to the interconnect device approximately equals zero.

3. The interconnect device of claim 1, wherein the first plurality of beam contacts includes:

a first portion oriented in a first direction; and a second portion oriented in an opposite direction relative to the first direction.

4. The interconnect device of claim 3, wherein the number of beam contacts of the first portion equals the number of beam contacts of the second portion.

5. The interconnect device of claim 2, wherein:

the first plurality of beam contacts includes a first portion oriented in a first direction and a second portion oriented in an opposite direction relative to the first direction; and the second plurality of beam contacts includes a third portion oriented in the first direction and a fourth portion oriented in the opposite direction.

6. The interconnect device of claim 5, wherein:

for the first plurality of beam contacts, the number of beam contacts of the first portion equals the number of beam contacts of the second portion; and for the second plurality of beam contacts, the number of beam contacts of the third portion equals the number of beam contacts of the fourth portion.

7. The interconnect device of claim 1, wherein:

the first component includes an integrated circuit; and the second component includes a printed circuit board.

8. An interconnect device, comprising:

a frame having an upper side and a lower side;

a first plurality of beam contacts on the upper side of the frame for connection to contacts of a first component, wherein the first plurality of beam contacts are arranged in columns such that the beam contacts in a first portion of the columns are oriented in a first direction and the beam contacts in a second portion of the columns are oriented in an opposite direction relative to the first direction, such that the sum of the sideways wipe forces caused by compression of the beam contacts in the first and second portions of the columns due to connection of the first component to the interconnect device approximately equals zero; and a second plurality of contacts on the lower side of the frame for connection to contacts of a second component, wherein each beam contact of the first plurality of contacts is electrically connected to a contact of the second plurality of contacts.

9. The interconnect device of claim 8, wherein first and second portions of the columns are arranged in an every-other-one arrangement.

10. The interconnect device of claim 8, wherein the second plurality of beam contacts are arranged in columns such that the beam contacts in a first portion columns on the lower side of the frame are oriented in the first direction and the beam contacts in a second portions of the columns on the lower side of the frame are oriented the opposite direction, such that the sum of the sideways wipe forces caused by compression of the beam contacts in the first and second portions of the columns due to connection of the second component to the interconnect device approximately equals zero.

11. An assembly, comprising:

a first component having a plurality of contacts;

a second component having a plurality of contacts; and an interconnect device connected between the first and second components, wherein the interconnect device includes:

a frame having an upper side and a lower side;

a first plurality of beam contacts on the upper side of the frame for connection to the contacts of the first component, wherein the first plurality of beam contacts are arranged such that the sum of the sideways wipe forces caused by compression of the first plurality of beam contacts due to connection of the first component to the interconnect device approximately equals zero; and a second plurality of contacts on the lower side of the frame for connection to the contacts of the second component, wherein each beam contact of the first plurality of contacts is electrically connected to a contact of the second plurality of contacts.

12. The assembly of claim 11, wherein the second plurality of contacts on the lower side of the frame includes beam contacts, wherein the second plurality of beam contacts are arranged such that the sum of the sideways wipe forces caused by compression of the second plurality of beam contacts due to connection of the second component to the interconnect device approximately equals zero.

13. The assembly of claim 11, wherein the first plurality of beam contacts includes:

a first portion oriented in a first direction; and a second portion oriented in an opposite direction relative to the first direction.

14. The assembly of claim 13, wherein the number of beam contacts of the first portion equals the number of beam contacts of the second portion.

15. The assembly of claim 12, wherein:

the first plurality of beam contacts includes a first portion oriented in a first direction and a second portion oriented in an opposite direction relative to the first direction; and the second plurality of beam contacts includes a third portion oriented in the first direction and a fourth portion oriented in the opposite direction.

16. The assembly of claim 15, wherein:

for the first plurality of beam contacts, the number of beam contacts of the first portion equals the number of beam contacts of the second portion; and for the second plurality of beam contacts, the number of beam contacts of the third portion equals the number of beam contacts of the fourth portion.

17. The assembly of claim 11, wherein:

the first component includes an integrated circuit; and the second component includes a printed circuit board.

18. A method of fabricating an interconnect device for electrically interconnecting a first component to a second component, comprising:

molding a frame of the interconnect device such that a plurality of electrical conductors are molded into the frame, each electrical conductor having a first beam contact portion extending from an upper side of the frame and a second beam contact portion extending from a lower side of the frame; and shaping the electrical conductors such that the first beam contact portions extending from the upper side of the frame are arranged such that the sum of the sideways wipe forces caused by compression of the first beam contact portions due to connection of the first component to the interconnect device approximately equals zero.

19. The method of claim 18, wherein shaping the electrical conductors further includes shaping the electrical conductors such that the second beam contact portions extending from the lower side of the frame are arranged such that the sum of the sideways wipe forces caused by compression of the second beam contact portions due to connection of the second component to the interconnect device approximately equals zero.

20. The method of claim 18, wherein the shaping step occurs after the molding step.

21. An interconnect device for electrically interconnecting a first component to a second component, comprising:

a frame having an upper side and a lower side;

a plurality of electrical conductors contacting the frame, wherein each of the plurality of conductors includes an upper beam contact, a lower contact, an a midsection therebetween, wherein:

the upper beam contacts are for connection to contacts of the first component;

the lower contacts are for connection to contacts of the second component; and the upper beam contacts are arranged such that the sum of the sideways wipe forces caused by compression of the upper beam contacts due to connection of the first component to the interconnect device approximately equals zero.

22. The interconnect device of claim 21, wherein the lower contacts include lower beam contacts, and wherein the lower beam contacts are arranged such that the sum of the sideways wipe forces caused by compression of the upper beam contacts due to connection of the second component to the interconnect device approximately equals zero.

23. The interconnect device of claim 21, wherein the midsection of at least one of the electrical conductors is molded in the frame.

24. The interconnect device of claim 21, wherein the midsection of at least one of the electrical conductors is disposed in a hole defined by the frame.

* * * * *

UNITED STATES PATENT AND TRADEMARK OFFICE

CERTIFICATE OF CORRECTION

PATENT NO. : 6,971,885 B2
APPLICATION NO. : 10/780936
DATED : February 18, 2004
INVENTOR(S) : Thomas E. Mowry et al.

It is certified that error appears in the above-identified patent and that said Letters Patent is hereby corrected as shown below:

On Title Page Item (57)

ABSTRACT

Line 3, delete "includes a frame having a upper side and a lower side" and substitute therefor --includes a frame having an upper side and a lower side--.

COLUMN 1

Line 52, delete "a interconnect device." and substitute therefor --an interconnect device--.

COLUMN 2

Line 17, delete "a frame having a upper side and a lower side" and substitute therefor --a frame having an upper side and a lower side--.

COLUMN 8

Line 60, delete "an a midsection" and substitute therefor --and a midsection--.

Signed and Sealed this

Twenty-sixth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 6,971,885 B2
APPLICATION NO. : 10/780936
DATED : December 6, 2005
INVENTOR(S) : Thomas E. Mowry et al.

It is certified that error appears in the above-identified patent and that said Letters Patent is hereby corrected as shown below:

On Title Page Item (57)

ABSTRACT

Line 3, delete "includes a frame having a upper side and a lower side" and substitute therefor --includes a frame having an upper side and a lower side--.

COLUMN 1

Line 52, delete "a interconnect device." and substitute therefor --an interconnect device--.

COLUMN 2

Line 17, delete "a frame having a upper side and a lower side" and substitute therefor --a frame having an upper side and a lower side--.

COLUMN 8

Line 60, delete "an a midsection" and substitute therefor --and a midsection--.

This certificate supersedes Certificate of Correction issued December 26, 2006.

Signed and Sealed this

Thirtieth Day of January, 2007

JON W. DUDAS
*Director of the United States Patent and Trademark Office*